US007807936B2

(12) United States Patent
Kim et al.

(10) Patent No.: US 7,807,936 B2
(45) Date of Patent: Oct. 5, 2010

(54) DEVICE FOR MOUNTING A PEDAL SWITCH TO A VEHICLE

(75) Inventors: Kyungmin Kim, Busan (KR); Hojong Oh, Busan (KR)

(73) Assignee: Donghee Industrial Co., Ltd. (KR)

( * ) Notice: Subject to any disclaimer, the term of this patent is extended or adjusted under 35 U.S.C. 154(b) by 253 days.

(21) Appl. No.: 12/111,292

(22) Filed: Apr. 29, 2008

(65) Prior Publication Data

US 2008/0273921 A1 Nov. 6, 2008

(30) Foreign Application Priority Data

May 2, 2007 (KR) ..... 10-2007-0042500

(51) Int. Cl.
*H01H 3/14* (2006.01)

(52) U.S. Cl. ..... 200/61.89; 200/16 C

(58) Field of Classification Search ..... 200/16 A–16 C, 200/296, 61.89
See application file for complete search history.

(56) References Cited

U.S. PATENT DOCUMENTS 2,142,107 A * 1/1939 Brown ..... 200/217
2,627,006 A * 1/1953 Lawson et al. ..... 200/531
2,803,728 A * 8/1957 Drury ..... 200/296
3,273,104 A * 9/1966 Krol ..... 439/557
3,299,238 A * 1/1967 Cobb ..... 200/530
4,015,626 A * 4/1977 Thordarson ..... 137/375
4,175,222 A * 11/1979 Buttner ..... 200/528
5,534,672 A * 7/1996 Meagher ..... 200/61.89

FOREIGN PATENT DOCUMENTS

JP 9-226542 9/1997
KR 10-1997-0004738 B1 4/1997
KR 10-2005-0119491 A 12/2005

* cited by examiner

*Primary Examiner*—Edwin A. Leon
*Assistant Examiner*—Vanessa Girardi
(74) *Attorney, Agent, or Firm*—Steptoe & Johnson LLP

(57) ABSTRACT

The present invention is to improve productivity and maintain a predetermined switch contact gap between a sensing rod and a stopper after mounting the pedal switch in order to accurately detect the operational conditions as the pedal arm is operated, by fastening a pedal switch to a mounting bracket fixed to the car body in one touch insertion way.

A device for fixing a pedal switch of a vehicle according to the present invention comprises a lock case 10 fastened to a mounting bracket 1 fixed to a car body; a return spring 20 disposed in the lock case 10; and a lock rod ring 30 disposed movably within a predetermined distance inside the lock case 10 and elastically supported by the return spring 20, and in which a sensing rod 42 of the pedal switch 40 is fastened.

8 Claims, 5 Drawing Sheets

DEVICE FOR MOUNTING A PEDAL SWITCH TO A VEHICLE

BACKGROUND OF THE INVENTION

1. Field of the Invention

The present invention relates to a device for fixing a pedal switch of a vehicle, particularly a device for fixing a pedal switch of a vehicle that makes it possible to simply mount a pedal switch to a mounting bracket fixed to a car body and maintain a predetermined gap from a stopper connected to a pedal arm.

2. Description of the Related Art

In general, a pedal switch, provided adjacent to a pedal arm to detect the operation of a clutch pedal or a brake pedal, detects that the clutch pedal or the brake pedal is pushed and then outputs the detected result to an involved system.

To achieve this function, according to a pedal switch according to the related art, as shown in FIG. 5, a sensing rod 5*a* of the pedal switch 5 is inserted into a through hole of a mounting bracket 1 and then the sensing rod 5*a* is fixed by two nuts 7.

In this configuration, because the sensing rod 5*a* needs to be a spaced apart at a predetermined switch contact gap (X) from a stopper 3*a* of a stopper bracket 3 fixed to a pedal arm (not shown), the worker re-adjusts the fastening position of the sensing rod 5*a* from the mounting bracket 1 by adjusting the position of the two nuts 7.

Spacing the sensing rod 5*a* at the predetermined switch contact gap (X) away from the stopper 3*a* is for avoiding unnecessary noise and vibration by preventing the stopper 3*a* from hitting the sensing rod 5*a* when the pedal arm that has been pushed returns.

Therefore, in the related art, it was necessary to appropriately adjust the switch contact gap (X) between the stopper 3*a* and the sensing rod 5*a* in mounting the pedal switch and a process for adjusting the gap was correspondingly added. Further, the time taken to adjust the switch contact gap (X) was increased, depending on the skill of the worker, such that productivity was deteriorated.

SUMMARY OF THE INVENTION

An object of the present invention is to improve productivity and maintain a predetermined switch contact gap between a sensing rod and a stopper after mounting the pedal switch in order to accurately detect the operational conditions as the pedal arm is operated, by fastening a pedal switch to a mounting bracket fixed to the car body in one touch insertion way.

In order to achieve the object of the invention, a device for fixing a pedal switch of a vehicle includes: a lock case fastened to a mounting bracket fixed to a car body; a return spring disposed in the lock case; and a lock rod ring disposed movably within a predetermined distance inside the lock case and elastically supported by the return spring, and in which a sensing rod of the pedal switch is fastened.

BRIEF DESCRIPTION OF THE DRAWINGS

The above and other features and advantages of the present invention will become more apparent by describing in detail preferred embodiments thereof with reference to the attached drawings in which.

DESCRIPTION OF THE PREFERRED EMBODIMENTS

Hereinafter, embodiments of the invention are described in detail with reference to the accompanying drawings.

Figure 1:
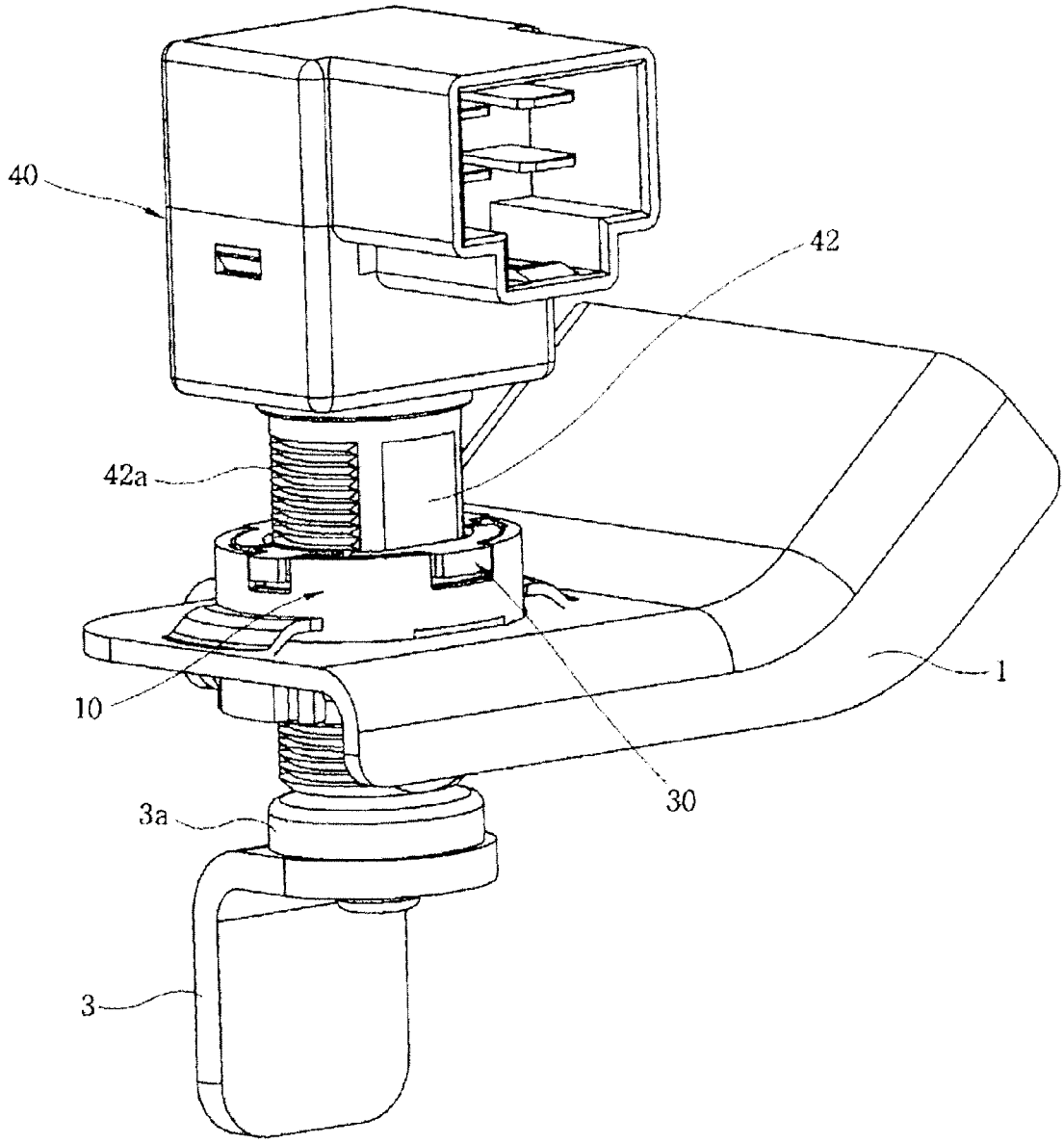
FIG. 1 is a view illustrated that a device for fixing a pedal switch according to an embodiment of the invention is mounted.
Figure 2:
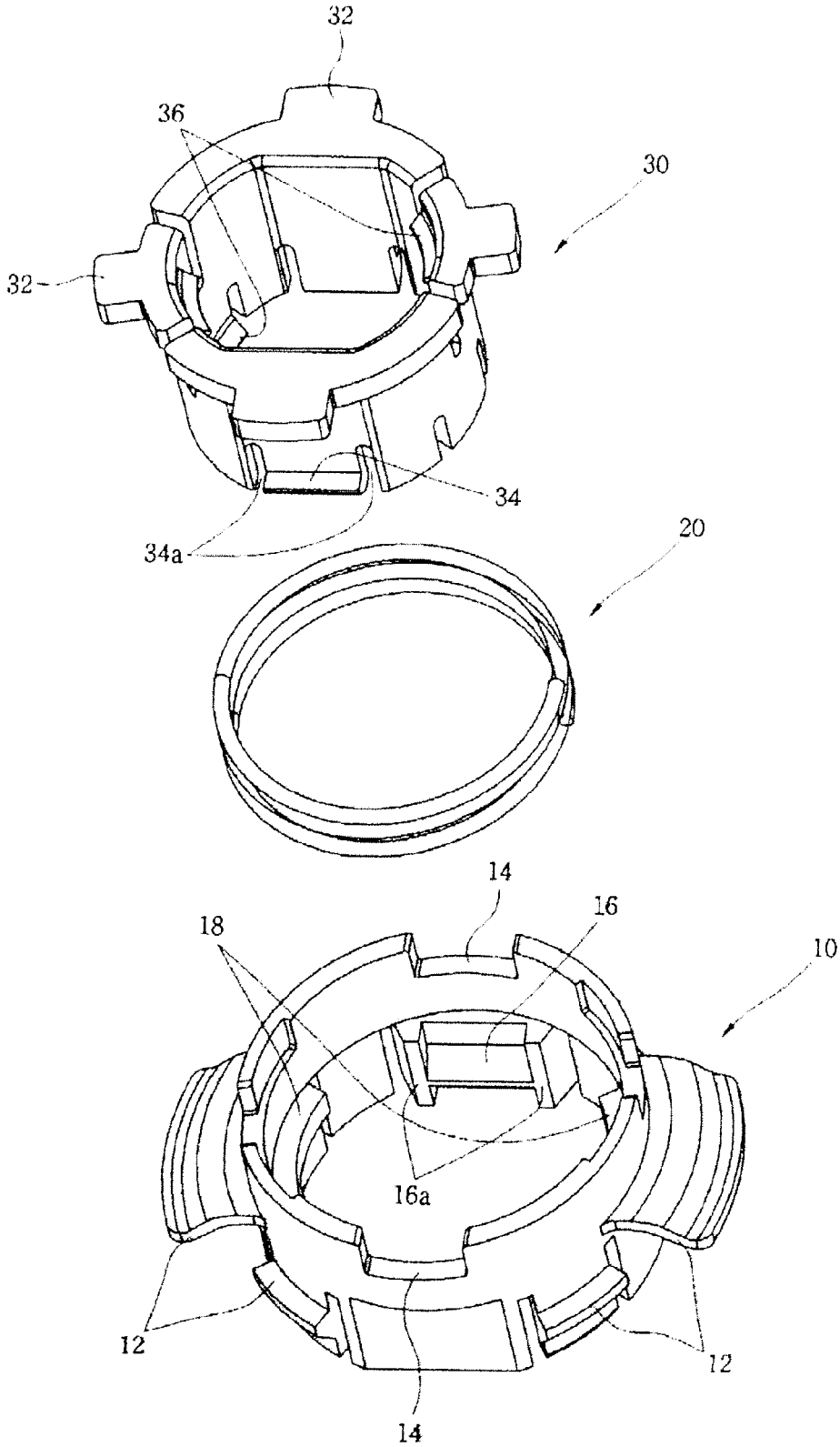
FIG. 2 is an exploded view illustrating the configuration of the device shown in FIG. 1.
Figure 3A:
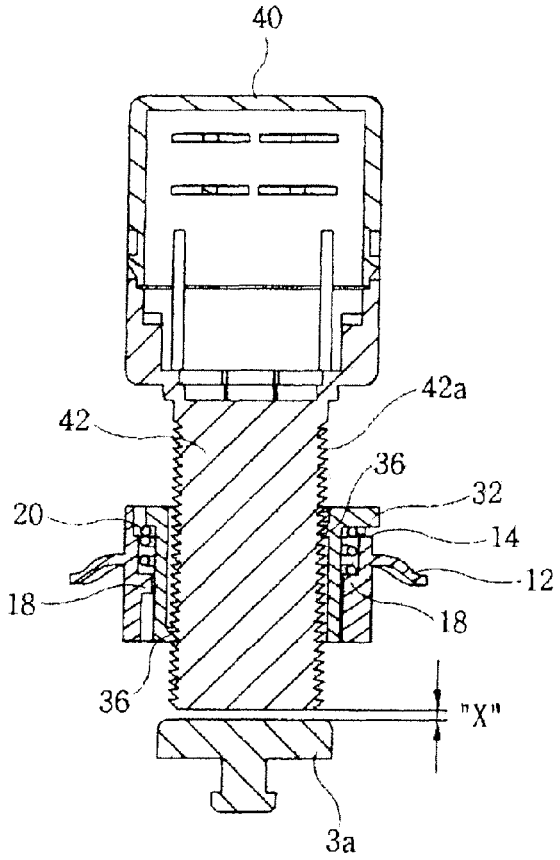
FIG. 3A shows a longitudinal cross-sectional view of a side of the device for fixing a pedal switch shown in FIG. 3B.
Figure 3B:
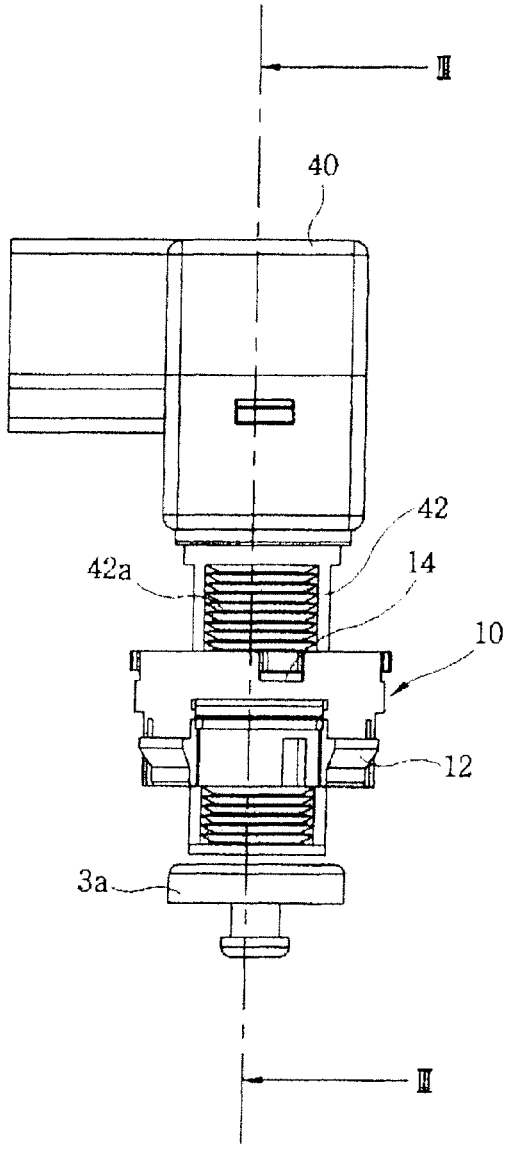
FIG. 3B shows a side view of the device for fixing a pedal switch shown in FIG. 1.
Figure 4A:
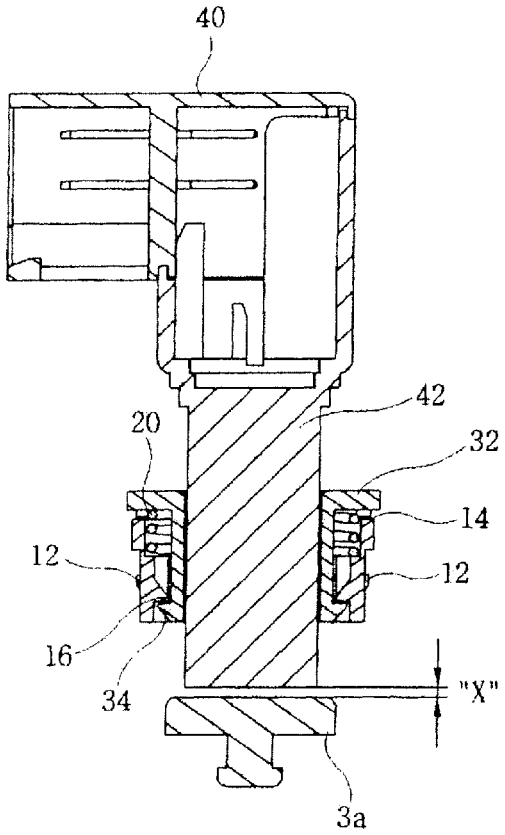
FIG. 4A shows a longitudinal cross-sectional view of the other side of the device for fixing a pedal switch shown in FIG. 4B.
Figure 4B:
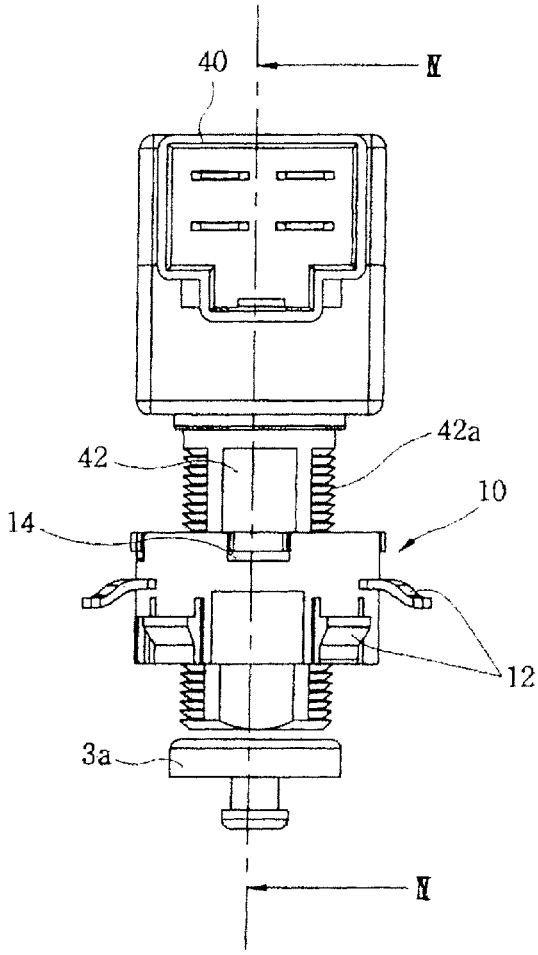
FIG. 4B shows a side view of the device for fixing a pedal switch shown in FIG. 1.
Figure 5:
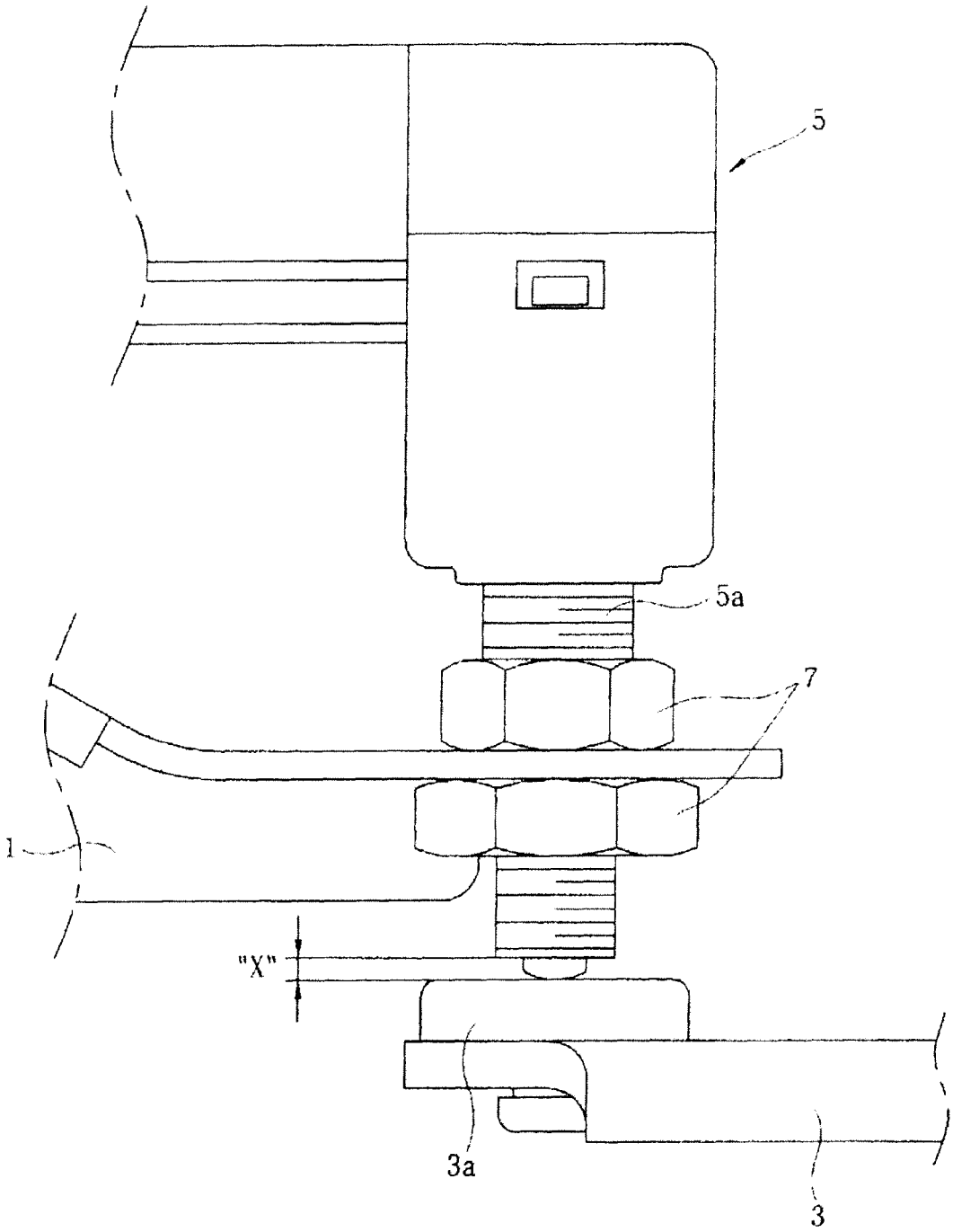
FIG. 5 is a view illustrating that a pedal switch is mounted in the related art.

As show in FIGS. 1 to 4B, an embodiment of the invention includes a lock case 10, a return spring 20, and a lock rod ring 30. The lock case 10 is combined and fixed to a mounting bracket 1 fixed to a car body. The return spring 20 is inserted in the lock case 10 and one end is supported. The lock rod ring 30 is elastically supported by the other end of the return spring 20 inside the lock case 10 and a sensing rod 42 of a pedal switch 40 that detects the operation of a pedal arm is fixed in the lock rod ring 30.

In this embodiment, both the lock case 10 and the lock rod ring 30 are hollow cylinder-shaped bodies.

In detail, the lock case 10 is inserted in a through hole (not shown) formed through the mounting bracket 1. The return spring 20 is inserted in the lock case 10 such that the lower end thereof is supported by the lock case 10. The lock rod ring 30 is elastically supported by the upper end of the return spring 20 inside the lock case 10, movably within a predetermined distance.

The lock rod ring 30 receives the sensing rod 42 of the pedal switch 40 and is engaged with a ratchet 42*a* formed around the outer circumference of the sensing rod 42, such that the sensing rod 42 is held movably within the predetermined distance inside the lock rod ring 30.

For this configuration, a plurality pairs of first outer lock protrusions 12 that protrudes outward and spaced apart at predetermined upper and lower positions is provided around the outer circumference of the lock case 10 to fix the lock case 10 with respect to the through hole (not shown) of the mounting bracket 1. The pair of first outer lock protrusions 12 each contacts with the upper and lower sides of the through hole of the mounting bracket 1 to fix the lock case 10 to the mounting bracket 1.

In this configuration, the first outer lock protrusions 12 are formed at predetermined positions spaced apart at regular intervals radially from the center around the entire outer circumference of the lock case 10. Preferably, the first outer lock protrusions 12 are discontinuous protrusions at predetermined positions spaced apart radially from the center around the entire outer circumference of the lock case 10.

Further, the lock case 10 has cut grooves 14 formed at the upper portion to limit the lower stroke of the lock rod ring 30, first inner lock protrusions 16 formed at lower portion around the inner circumference to limit the upper stroke of the lock rod ring 30, and protruding support seats 18 formed at the center portion in the longitudinal direction around the inner circumference to support the lower end of the return spring 20.

In this configuration, the cut grooves 14 and the first inner lock protrusions 16 are formed at a plurality of positions spaced apart at regular intervals radially from the center around the entire circumference of the lock case 10. Preferably, the cut grooves 14 are discontinuous opened grooves and the first inner lock protrusions 16 are discontinuous protrusions, spaced apart radially from the center around the entire circumference of the lock case 10.

Further, the protruding support seats 18 are formed at a plurality of positions spaced apart at regular intervals radially from the center around the entire inner circumference of the lock case 10. Preferably, the protruding support seats 18 are discontinuous protrusions spaced apart radially from the center around the entire inner circumference of the lock case 10.

Further, the lock rod ring 30 has upper protrusions 32 that are fitted in the cut grooves 14, second outer lock protrusions 34 that are formed at the lower portion, and locked and supported by the first inner lock protrusions 16, and second inner lock protrusions 36 that lock and support the sensing rod 42. Preferably, the upper protrusions 32, the second outer lock protrusions 34, and the second inner lock protrusions 36 are discontinuous protrusions spaced apart radially from the center around the entire circumference of the lock rod ring 30.

In this configuration, the second inner lock protrusions 36 have slopes in one direction at the end portions to be engaged with the ratchets 42*a* that are continuously formed with a predetermined range of the entire length of the outer circumference of the sensing rod 42, having slopes in one direction.

Further, the second inner lock protrusions 36 are formed at predetermined upper and lower symmetric positions around the entire inner circumference of the lock rod ring 30. In this embodiment, the second inner lock protrusions 36 are formed at upper and lower positions spaced apart at 180° around the inner circumference or the lock rod ring 30, such that they fix the sensing rod 42 of the pedal switch 40 and prevent the sensing rod 42 from moving left/right in the lock rod ring 30.

Furthermore, guide protrusions 16*a* that vertically protrude at both sides of the first inner lock protrusion 16 are integrally formed with the first inner circumference of the lock case 10 and guide slots 34*a* that are vertically cut at both sides of the second outer lock protrusion 34 and fitted around the guide protrusions 16*a* are formed at the lower portion of the lock rod ring 30. Therefore, when the lock rod ring 30 is inserted in the lock case 10, the guide protrusions 16 are fitted in the guide slots 34*a*, such that the lock rod ring 30 is positioned in place inside the lock case 10.

Hereafter, a process of mounting a pedal switch of a vehicle according to an embodiment of the invention is described in detail.

First, the lock case 10 is inserted into the through hole of the mounting bracket 1 such that it is fixed by the first outer lock protrusions 12, and then the return spring 20 is inserted into the lock case 10.

The lower end of the return spring 20 is supported by the protruding support seats 18 formed around the inner circumference of the lock case 10.

Next, the lock rod ring 30 is inserted into the lock case 10 such that it is elastically supported by the return spring 20 inside the lock case 10, and of which movement is restricted by the first inner lock protrusions 16 locking the second outer lock protrusions 34, in which the upper end of the return spring 20 is in contact with the bottom of the upper protrusions 32 of the lock rod ring 30.

Subsequently, the sensing rod 42 of the pedal switch 40 is inserted into the lock rod ring 30, in which the sensing rod 42 is pushed until the lower end contacts with the surface of the stopper 3*a* of the stopper bracket 30 fixed to the pedal arm (not shown).

The stroke of the sensing rod 42 may be restricted by the distance between the cut groove 14 of the lock case 10 and the upper protrusion 32 of the lock rod ring 30. That is, the pedal switch 40 may be mounted to the mounting bracket 1 before the stopper bracket 3 is disposed.

Further, the ratchets 42*a* formed on the outer circumference of the sensing rod 42 are engaged with the second inner lock protrusions 36 formed on the inner circumference of the lock rod ring 30, such that they are locked, in which the return spring 20 is compressed in a space between the protruding support seats 18 of the lock case 10 and the protrusions 32 of the lock rod ring 30.

Thereafter, as the force applied to the pedal switch 40 is released, the lock rod ring 30 is lifted by a return force of the return spring 20 and the upper stroke of the lock rod ring 30 is made until the first inner lock protrusions 16 contact with the second outer lock protrusions 34.

Therefore, the pedal switch 40 is mounted to the mounting bracket 1 as described above, the switch contact gap (X) between the lower end of the sensing rod 42 and the upper portion of the stopper 3*a* is always maintained at a predetermined size.

As described above, according to a device for fixing a pedal switch of a vehicle of the invention, it is possible to fasten a pedal switch to a mounting bracket fixed to the car body in one touch insertion way, such that it is possible to improve productivity in mounting the pedal switch to the mounting bracket and maintain a predetermined switch contact gap between a sensing red and a stopper after mounting the pedal switch. Therefore, it is possible to accurately detect the operational conditions as the pedal arm is operated.

Further, since the predetermined switch contact gap is secured between the sensing rod of the pedal switch and the stopper, as the pedal arm is operated, the pedal switch can accurately detects the operations conditions of the pedal arm. Accordingly, it can be expected from a system that is involved with the pedal switch and detects the operational conditions of the vehicle to achieve more stable operation.

What is claimed is:

1. A device for fixing a pedal switch of a vehicle, comprising:

a lock case fastened to a mounting bracket fixed to a car body;

a return spring disposed in the lock case; and a lock rod ring disposed movably within a predetermined distance inside the lock case and elastically supported by the return spring, and in which a sensing rod of the pedal switch is fastened, wherein the lock case comprises cut grooves formed at an upper portion to limit a lower stroke of the lock rod ring, and further has first inner lock protrusions formed at a lower portion around an inner circumference of the lock case to limit an upper stroke of the lock rod ring, and protruding support seats are also formed around the inner circumference to support a lower end of the return spring.

2. The device as set forth in claim 1, wherein the cut grooves, the first inner lock protrusions, and the protruding support seat are formed at a plurality of positions spaced apart at regular intervals around the entire inner circumference of the lock case.

3. The device as set forth in claim 1, wherein a plurality of first outer lock protrusions are spaced apart at predetermined upper and lower positions are provided around an outer circumference of the lock case to fix the lock case with respect to the mounting bracket.

4. The device as set forth in claim 3, wherein the plurality of first outer lock protrusions are formed at predetermined positions spaced apart at regular intervals around the entire outer circumference of the lock case.

5. The device as set forth in claim 1, wherein the lock rod ring has upper protrusions that are fitted in the cut grooves, second outer lock protrusions that are formed at a lower portion which are locked and supported by the first inner lock protrusions, and second inner lock protrusions that lock and support the sensing rod.

6. The device as set forth in claim 5, wherein guide protrusions vertically protruding at both sides of the first inner lock protrusion are formed around the inner circumference of the lock case, and vertical guide slots at both sides of the second outer lock protrusion are fitted around the guide protrusions and formed at the lower portion of the lock rod ring.

7. The device as set forth in claim 5, wherein the second inner lock protrusions each have a slope in one direction to be engaged with a ratchet formed on the sensing rod.

8. The device as set forth in claim 7, wherein the second inner lock protrusions are formed at predetermined upper and lower symmetric positions around the entire inner circumference of the lock rod ring.

* * * * *